US008042719B2

(12) United States Patent
Lee

(10) Patent No.: US 8,042,719 B2
(45) Date of Patent: Oct. 25, 2011

(54) POWDER-ACTUATED FASTENER-DRIVING DEVICE HAVING SOUND-ABSORBING FUNCTION

(76) Inventor: Chung-Yi Lee, Taipei (TW)

( * ) Notice: Subject to any disclaimer, the term of this patent is extended or adjusted under 35 U.S.C. 154(b) by 103 days.

(21) Appl. No.: 12/686,846

(22) Filed: Jan. 13, 2010

(65) Prior Publication Data

US 2011/0168754 A1 Jul. 14, 2011

(51) Int. Cl.
*B25C 1/08* (2006.01)

(52) U.S. Cl. ..... 227/10; 227/9; 227/11

(58) Field of Classification Search ..... 227/9, 2, 227/10, 11; 181/230, 223, 205, 241
See application file for complete search history.

(56) References Cited

U.S. PATENT DOCUMENTS 2,789,653 A * 4/1957 Fannen ..... 181/230
3,235,154 A * 2/1966 Mulno ..... 227/10
3,622,060 A * 11/1971 Gussalli ..... 227/8
3,743,048 A * 7/1973 Bakoledis ..... 181/230
4,501,189 A * 2/1985 Brandl et al. ..... 89/14.4
6,059,162 A * 5/2000 Popovich et al. ..... 227/10

* cited by examiner

*Primary Examiner* — Sameh H. Tawfik
*Assistant Examiner* — Nathaniel Chukwurah
(74) *Attorney, Agent, or Firm* — Brinks Hofer Gilson & Lione

(57) ABSTRACT

A powder-actuated fastener-driving device includes a hollow body including a tubular portion and a handle, and an inner tube movable forwardly and rearwardly within the tubular portion and having a front end disposed outwardly of the tubular portion, and a slot. The front end of the inner tube has an outer surface formed with a position-limiting groove. A stop member is disposed within the tubular portion, and extends into the slot. A sound-absorbing sleeve is sleeved movably on a portion of the tubular portion disposed outwardly of the handle, and has an inner surface formed with a position-limiting block, which is movable forwardly and rearwardly within the position-limiting groove. When the front end of the inner tube is pressed forwardly against an object, the sound-absorbing sleeve comes into contact with the handle.

14 Claims, 16 Drawing Sheets

POWDER-ACTUATED FASTENER-DRIVING DEVICE HAVING SOUND-ABSORBING FUNCTION

BACKGROUND OF THE INVENTION

1. Field of the Invention

This invention relates to a powder-actuated fastener-driving device, and more particularly to a powder-actuated fastener-driving device having sound-absorbing function.

2. Description of the Related Art

Referring to FIG. 1, a conventional powder-actuated fastener-driving device 1 is operable in a single shot mode, and includes a hollow body 11 having a tubular portion 111 at a front end thereof, an inner tube 12 movable forwardly and rearwardly, a cartridge-receiving sleeve 13 connected to the inner tube 12 and having a rear end formed with an accommodating chamber 131 for accommodating a powder cartridge (not shown), a piston 14 movable forwardly and rearwardly and driven by the powder cartridge when the powder cartridge is ignited, and a firing device 15 for igniting the powder cartridge. The inner tube 12 is formed with a slot 121 extending along a front-to-rear direction. The tubular portion 111 is provided with a stop member unit 16 that includes a stop member 161 extending into the slot 121 and biased by a spring to press against the inner tube 12. For safety concern, during use, to change the device 1 into a ready-to-fire state, the device 1 needs to be pressed against a workpiece to move the inner tube 12 rearwardly and compress a firing-device biasing spring, so that the charge cannot be detonated by inadvertent actuation of the trigger device. After a nail shooting operation, to return the piston 14 to its original position in preparation for performing a subsequent nail shooting operation, it is necessary to pull the inner tube 12 forwardly. During forward movement of the inner tube 12, the piston 14 comes into contact with the stop member 161 to thereby move rearwardly in the inner tube 12. Thereafter, the inner tube 12 is pushed rearwardly back to its original position, thereby returning the piston 14 to its original position.

The tubular portion 111 is formed with an aperture 112 in a wall thereof such that, when the inner tube 12 is pulled forwardly to a front limit position, the cartridge-receiving sleeve 13 is exposed within the aperture 112 to allow for replacement of the powder cartridge in the accommodating chamber 131 in the cartridge-receiving sleeve 13.

When the powder cartridge is ignited, combustion gas produced due to explosion of powder in the powder cartridge is sprayed into the atmosphere via the slot 121 in the inner tube 12. Rapid expansion of the gas results in a relatively large amount of noise. Furthermore, flow of the gas through the aperture 112 in the tubular portion 111 also results in generation of noise.

To reduce the noise, many different designs of fastener-driving devices have been proposed. For example, a push rod is provided to push and return the piston 14 to its original position. As such, the slot 121 can be omitted. Use of the push rod, however, affects adversely the operating efficiency of the fastener-driving device. In addition, U.S. Pat. No. 7,575,139 employs nails having a specific structure, thereby increasing the manufacturing costs of the nails. As a result, the fastener-driving devices 2 including the slots 121 and the stop members 161 are still used widely, and it is desirable that the fastener-driving device 2 has a sound-absorbing function.

U.S. Pat. No. 3,743,048 discloses an improved powder-actuated fastener-driving device having a sound-absorbing function and including a sound-absorbing sleeve (i.e., sound muffler) disposed fixedly on a barrel or inner tube. However, the improved powder-actuated fastener-driving device suffers from the following disadvantages:

(1) As long as a force is applied to the sound-absorbing sleeve to move the sound-absorbing sleeve rearwardly relative to a handle of the improved powder-actuated fastener-driving device, the inner tube is moved synchronously with the sound-absorbing sleeve and thereby the device will be changed into a ready-to-fire state without pressing the inner tube against the workpiece. As a consequence, the improved powder-actuated fastener-driving device is dangerous during use.

(2) A large amount of powder residue is inevitably built-up within the inner tube, and is deposited on a piston or driving ram and the inner surface of the inner tube, in view of the fact that the gas flows from the inner tube 12 via a front end portion of the inner tube 12, thereby affecting adversely movement of the piston or driving ram within a housing.

(3) The hot gas produced due to powder explosion is sprayed from the improved powder-actuated fastener-driving device onto the user in a rearward direction, thereby resulting in a discomfort feeling to the user.

(4) Since the sound-absorbing sleeve moves synchronously with the inner tube, a larger force is required to move the sound-absorbing sleeve between two positions.

SUMMARY OF THE INVENTION

The object of this invention is to provide a powder-actuated fastener-driving device, which includes a stop member, an inner tube formed with a slot and operable to return a piston to its original position, effective gas-guiding means, and a sound-absorbing sleeve that is operable with ease.

According to this invention, there is provided a powder-actuated fastener-driving device comprising:

a hollow body including a tubular portion having a rear end and an aperture formed through a wall thereof, and a handle including a handle body sleeved on the rear end of the tubular portion;

an inner tube movable forwardly and rearwardly within the tubular portion of the body and having a front end disposed outwardly of the tubular portion, and a slot formed through a wall of the inner tube and extending along a front-to-rear direction, the front end of the inner tube having an outer surface formed with a position-limiting groove;

a firing device disposed within the handle body of the body and adapted for igniting a powder cartridge;

a piston movable forwardly and rearwardly within the inner tube and adapted to be driven by the powder cartridge when the powder cartridge is ignited;

a stop member disposed on the tubular portion of the body and extending into the slot in the inner tube; and a sound-absorbing sleeve that is sleeved on a portion of the tubular portion disposed outwardly of the handle and that has an inner surface formed with a position-limiting block, the position-limiting block being movable forwardly and rearwardly within the position-limiting groove to allow for forward and rearward movement of the inner tube and the sound-absorbing block relative to each other such that, when the front end of the inner tube is pressed forwardly against an object, a rear end of the sound-absorbing sleeve comes into contact with a front end of the handle, synchronous forward movement of the inner tube and the sound-absorbing sleeve being allowed when the position-limiting block is disposed at a front end of the position-limiting groove and when the inner tube is movable forwardly relative to the hollow body, synchronous rearward movement of the inner tube and the sound-absorbing sleeve being allowed when the position-limiting block is disposed at a rear end of the position-limiting groove and when the inner tube is movable rearwardly relative to the hollow body, the sound-absorbing sleeve being movable away from the handle to expose the aperture outwardly of the sound-absorbing sleeve, thereby allowing for replacement of the powder cartridge;

wherein the tubular portion of the body is formed with a gas-guiding hole formed in a rear end portion thereof and aligned with the slot in the inner tube to allow gas produced within the inner tube during explosion of powder in the powder cartridge to be discharged from the powder-actuated fastener-driving device through the slot and the gas-guiding hole.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
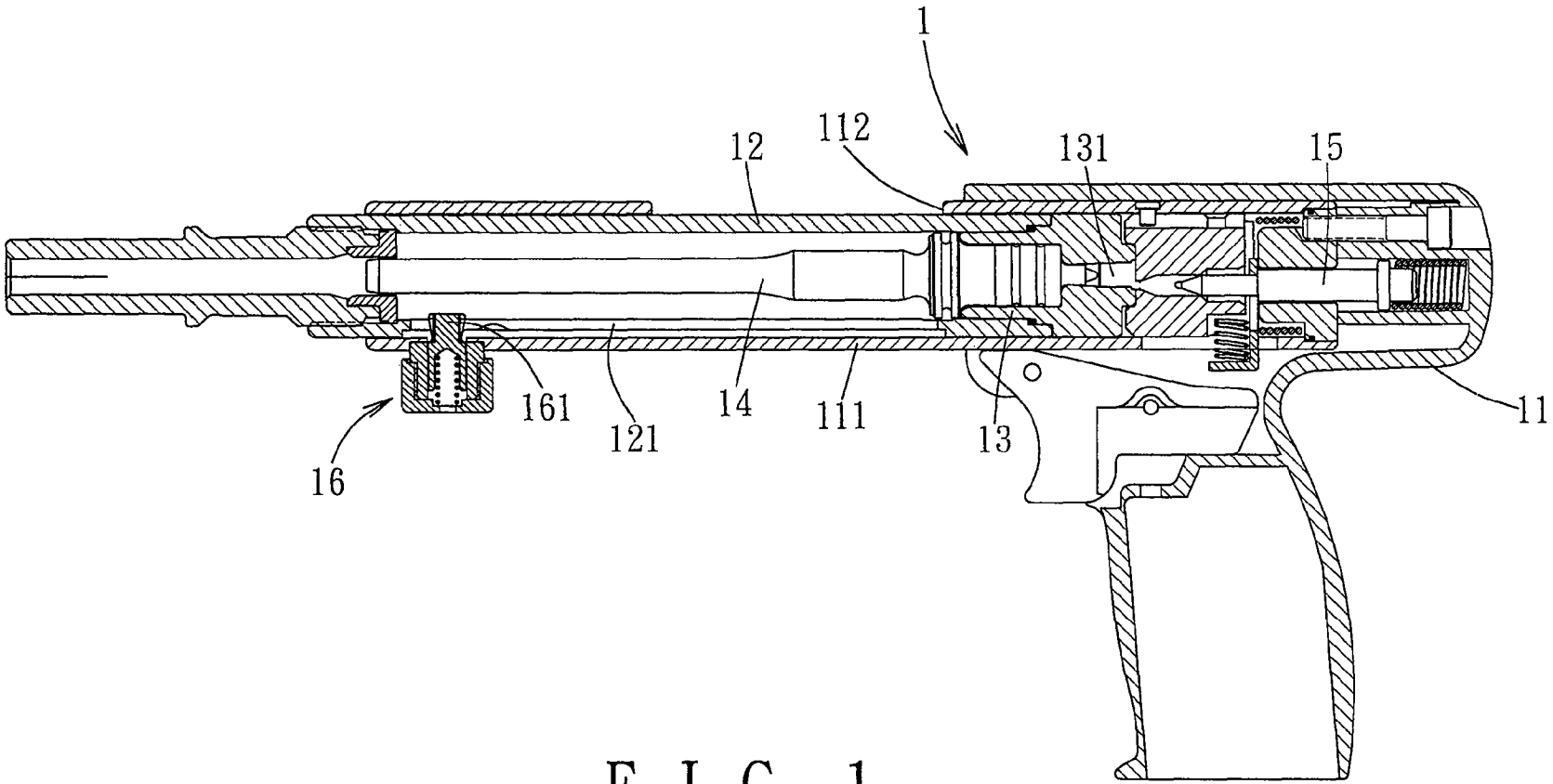
FIG. 1 PRIOR ART
FIG. 1 is a schematic sectional view of a conventional powder-actuated fastener-driving device.

Before the present invention is described in greater detail in connection with the preferred embodiments, it should be noted that similar elements and structures are designated by like reference numerals throughout the entire disclosure.

Figure 2:
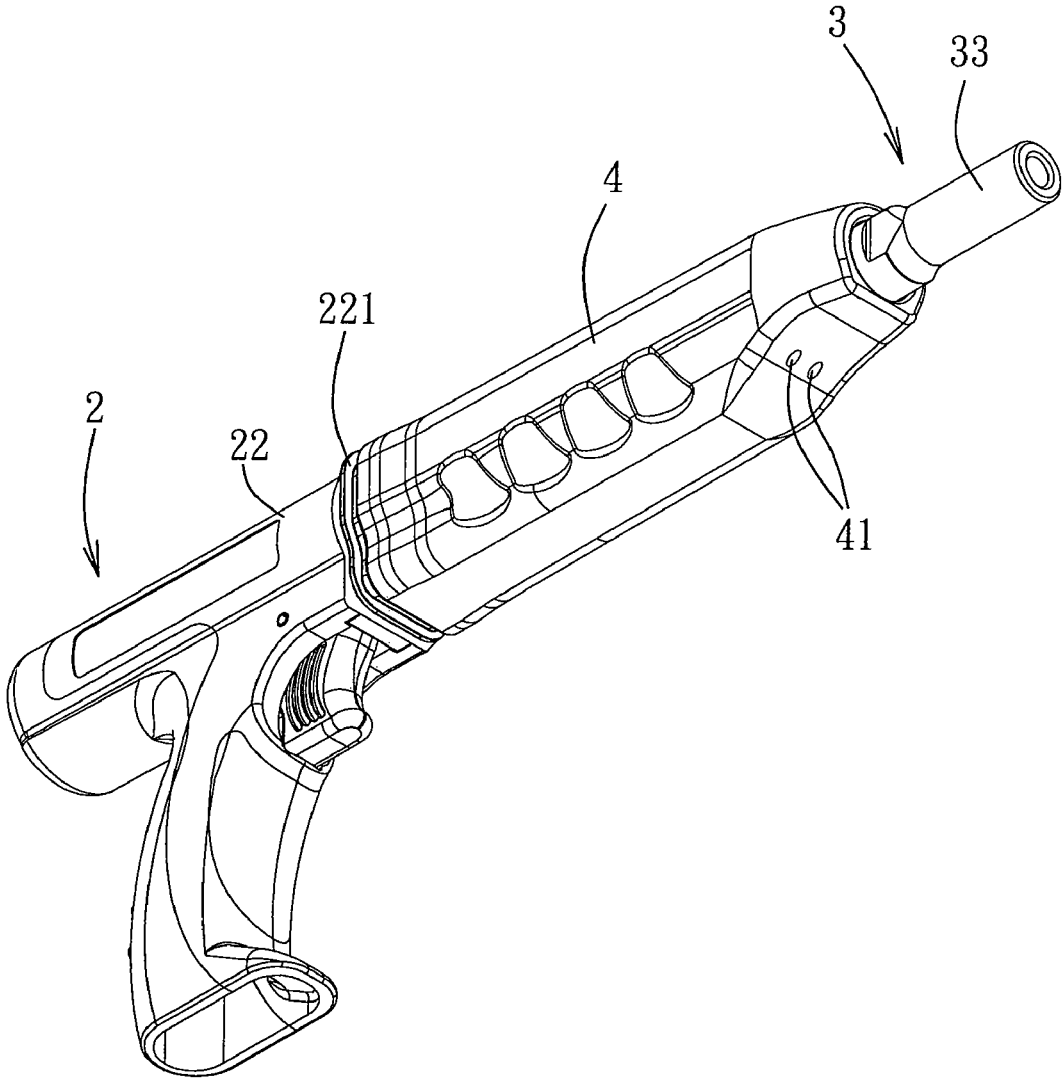
FIG. 2 is an assembled perspective view of the first preferred embodiment of a powder-actuated fastener-driving device according to this invention.
Figure 3:
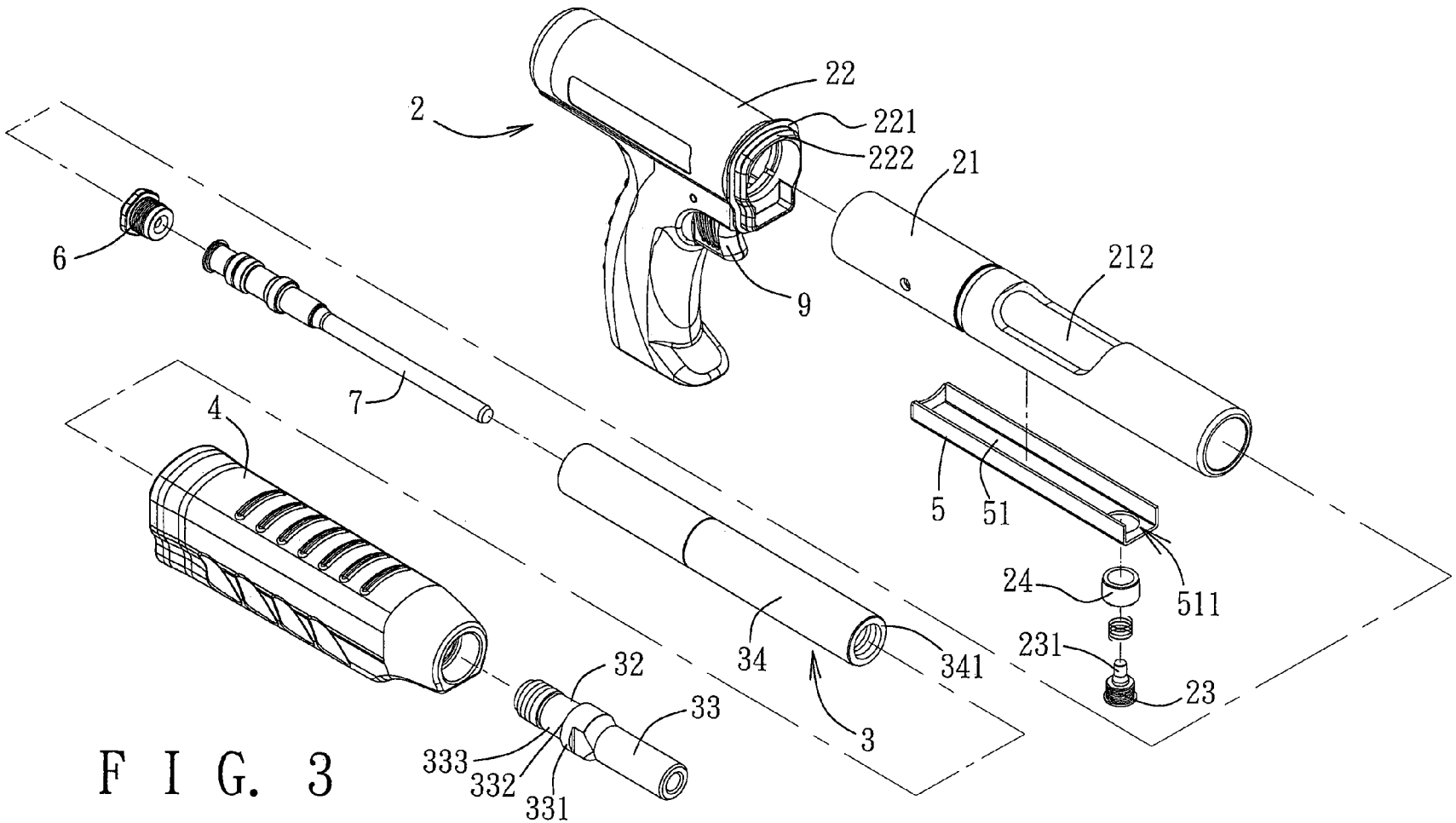
FIG. 3 is an exploded perspective view of the first preferred embodiment.
Figure 4:
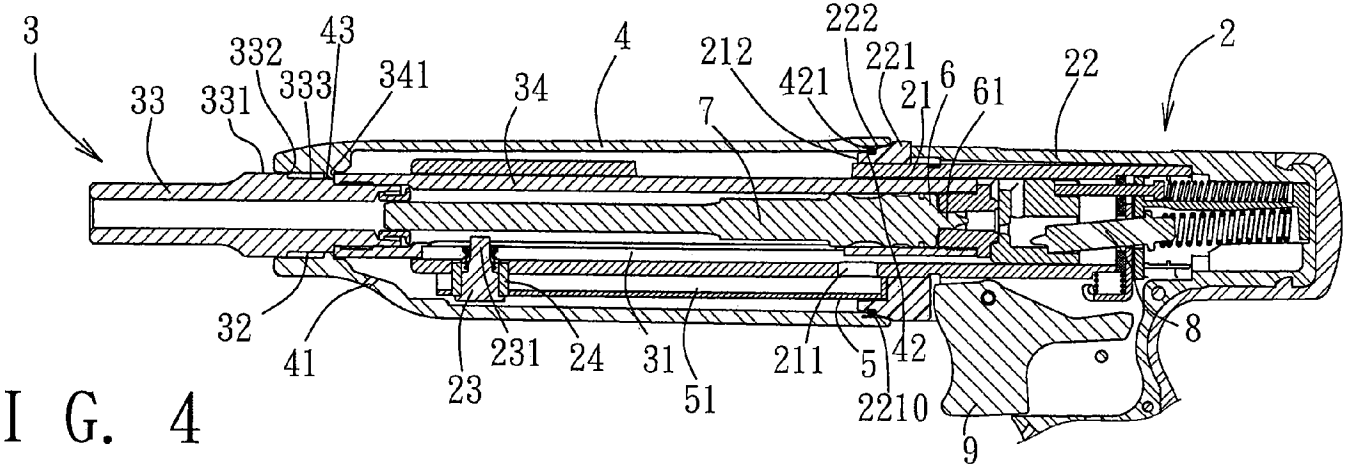
FIG. 4 is a sectional view of the first preferred embodiment, illustrating an inner tube in a normal position.

Referring to FIGS. 2, 3, and 4, the first preferred embodiment of a powder-actuated fastener-driving device according to this invention includes a hollow body 2, an inner tube 3, a cartridge-receiving sleeve 6, a piston 7, a firing device 8, a trigger 9, and a sound-absorbing sleeve 4.

The body 2 is shaped as a gun, and includes a tubular portion 21 and a handle body 22 sleeved on a rear end of the tubular portion 21. The inner tube 3 is movable forwardly and rearwardly within the tubular portion 21, and has a front end disposed outwardly of the tubular portion 21. The cartridge-receiving sleeve 6 engages threadably a rear end of the inner tube 3, and has a rear end formed with an accommodating chamber 61 for accommodating a powder cartridge (not shown). The piston 2 is shaped as a rod, and is movable forwardly and rearwardly within the inner tube 3. The firing device 8 is disposed within the handle body 22 of the body 2 for igniting the powder cartridge in the accommodating chamber 61 in the cartridge-receiving sleeve 6. The trigger 9 can be operated to fire a nail from the powder-actuated fastener-driving device. When the powder cartridge is ignited to explode, the piston 7 is pushed by the gas produced due to the explosion of the powder cartridge to move forwardly within the body 2 for driving a nail (not shown).

It should be noted that, the powder-actuated fastener-driving device of this invention is operated in a single shot mode. The inner tube 3 has a slot 31 formed through a bottom wall thereof and extending along a front-to-rear direction. A stop member 23 is mounted on the tubular portion 21 by a coupling member 24, and extends into the slot 31 in the inner tube 3. In this embodiment, the coupling member 24 is configured as a cylinder, and extends through a bottom wall of the tubular portion 21. The stop member 23 is configured as a bolt threaded into the coupling member 24, and has a projecting section 231 disposed within the slot 31. The stop member 23 and the slot 31 in the inner tube 3 are provided for returning the piston 7 to its original position after one nail-driving operation.

Figure 6:
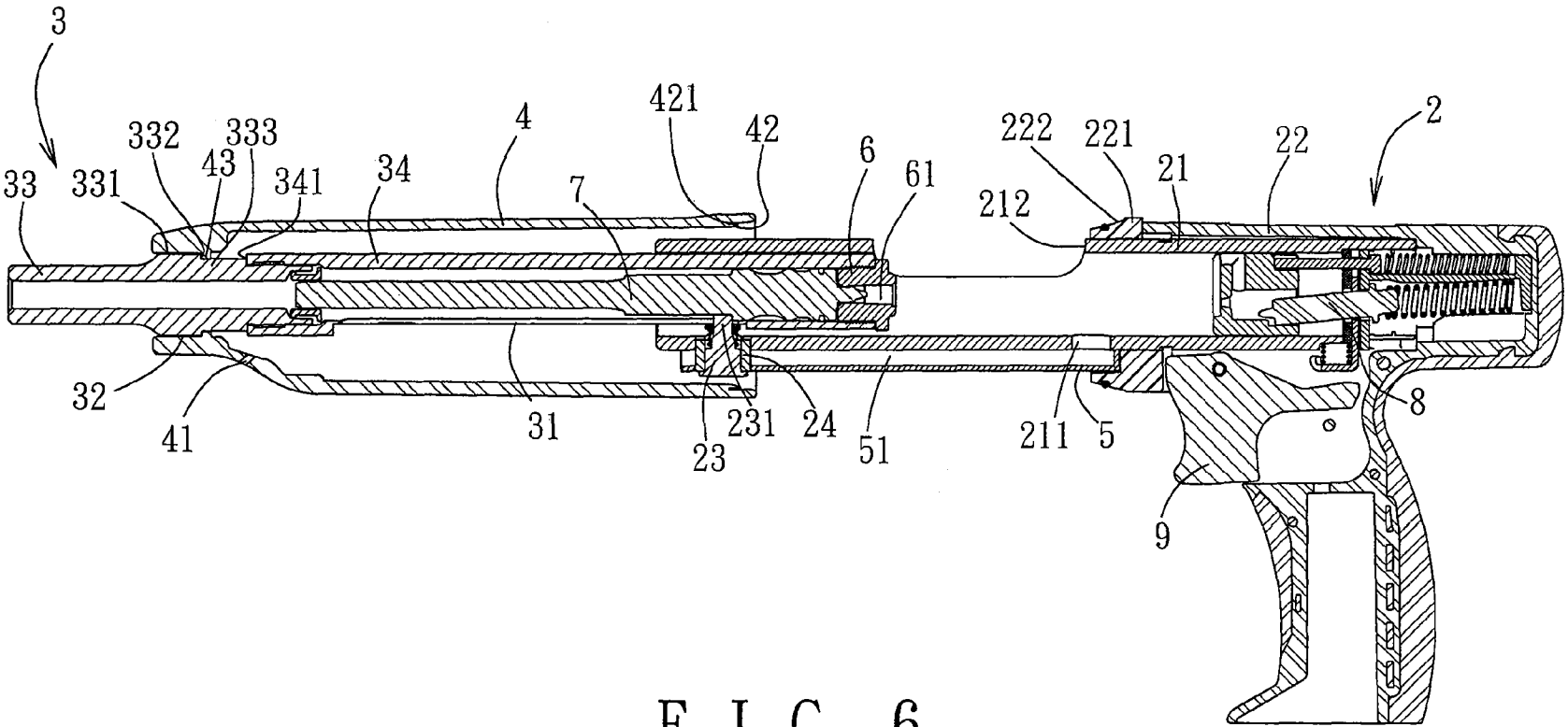
FIG. 6 is a view similar to FIG. 4 but illustrating the inner tube in a front limit position.

A top wall of the tubular portion 21 has an aperture 212 formed therethrough. When the inner tube 3 is moved relative to the body 2 to a front limit position shown in FIG. 6, the cartridge-receiving sleeve 6 is exposed within the aperture 212 so as to allow for replacement of the powder cartridge in the accommodating chamber 61 in the cartridge-receiving sleeve 6.

The sound-absorbing sleeve 4 is sleeved on a portion of the tubular portion 21 disposed outwardly of the handle body 22, and has a front end connected to the front end of the inner tube 3. The manner in which the sound-absorbing sleeve 4 is connected to the front end of the inner tube 3 will be described hereinafter.

To promote the sound-absorbing function, a seal may be established between the rear end of the sound-absorbing sleeve 4 and the front end of the handle body 22. In this embodiment, to establish such a seal, the body 2 further includes a sealing member 221 sleeved on the front end of the handle body 22. The sealing member 221 cooperates with the handle body 22 to constitute a handle. In this embodiment, the sealing member 221 includes an O-ring 2210 made of an elastic material, and the sound-absorbing sleeve 4 is made of a rigid material. Since the handle body 22 is also rigid to maintain the tool strength, the sealing member 221 can be clamped between the sound-absorbing sleeve 4 and the front end of the handle body 22 to ensure the sealing effect.

In this embodiment, an inner surface of the sound-absorbing sleeve 4 has an annular inclined surface portion 42 formed with an annular groove 421, and an outer surface of the sealing member 221 has an annular inclined surface portion 222. When the sound-absorbing sleeve 4 abuts against the sealing member 221, the annular inclined surface portion 42 of the sound-absorbing sleeve 4 is in contact with the annular inclined surface portion 222 of the sealing member 221 to promote the sealing effect. Furthermore, due to the presence of the annular groove 421 in the inclined surface portion 42, the sealing effect is further promoted as it increases the elasticity of the contact area.

Figure 15:
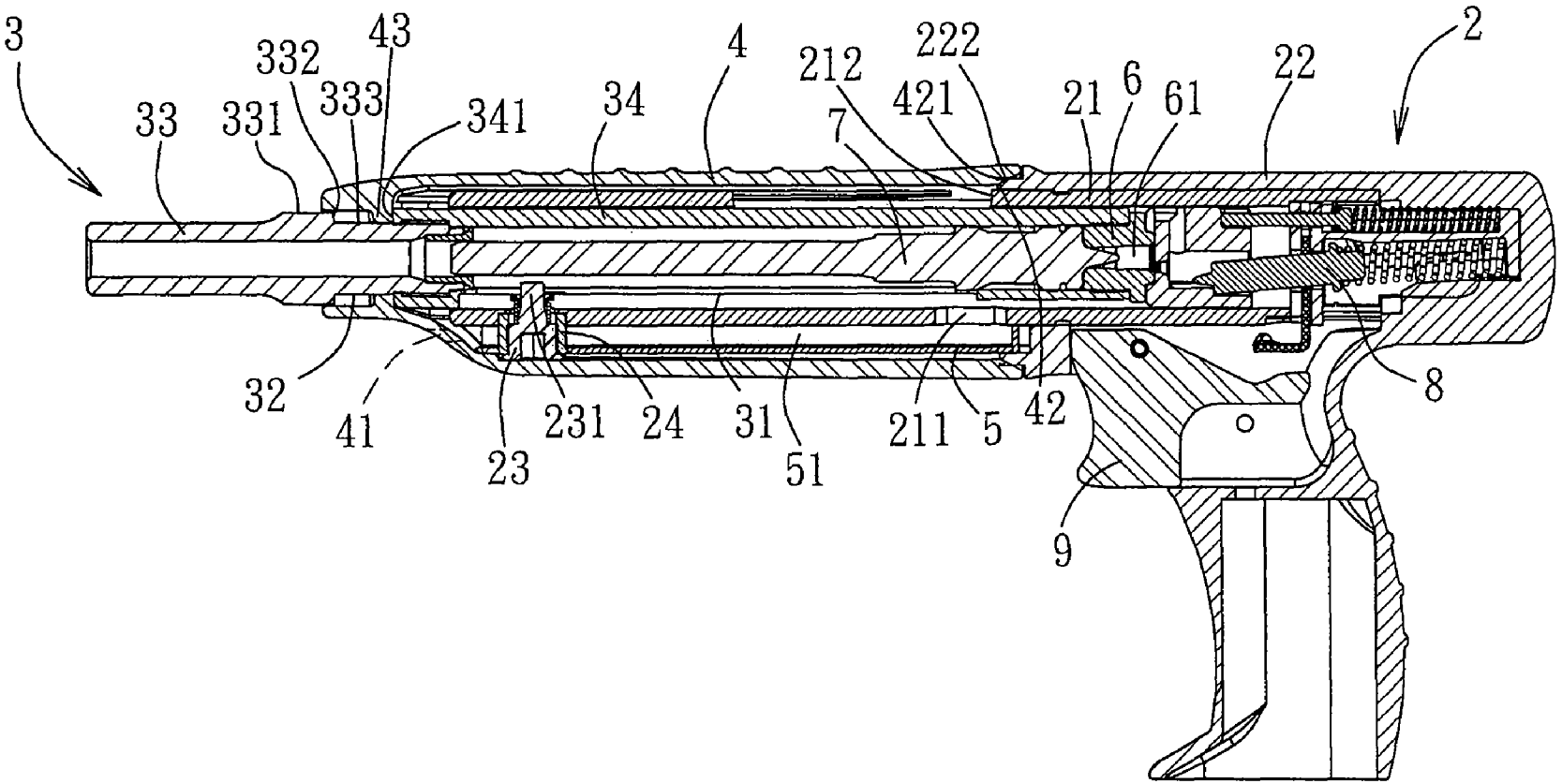
FIG. 15 is a sectional view of the fourth preferred embodiment of a powder-actuated fastener-driving device according to this invention.

Alternatively, the sealing member 221 may be omitted from the body 2. The annular inclined surface portion 222 is disposed at the outer surface of the handle body 22, as shown in FIG. 15.

The tubular portion 21 of the body 2 is formed with a gas-guiding hole 211 disposed at a rear end portion thereof and aligned with the slot 31 in the inner tube 3 to allow gas produced within the inner tube 3 to be discharged from the powder-actuated fastener-driving device through the slot 31 and the gas-guiding hole 211 during explosion of powder in the powder cartridge. The tubular portion 21 may be formed with a plurality of gas-guiding holes 211.

Figure 16:
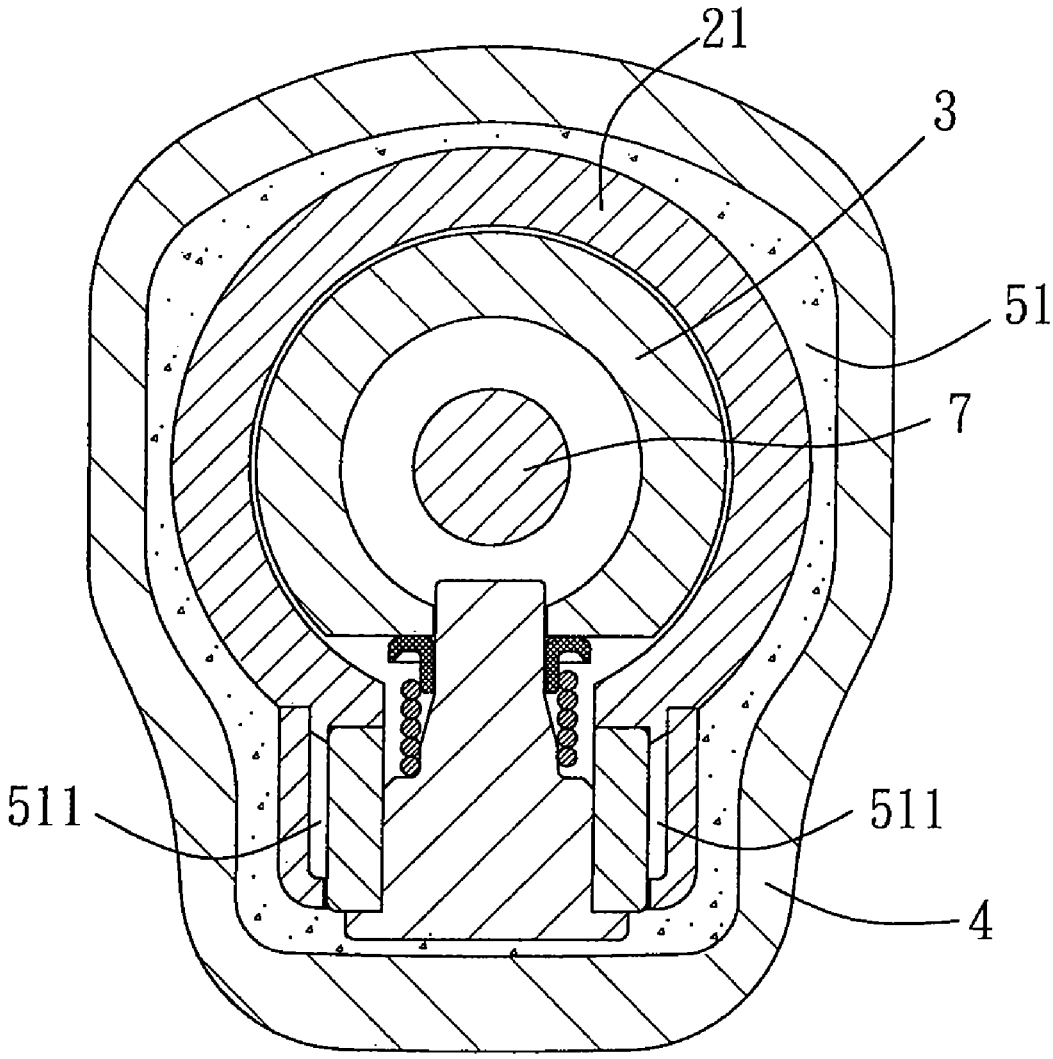
FIG. 16 is a sectional view taken along line 16-16 in FIG. 6A.

To improve the gas-guiding effect, the powder-actuated fastener-driving device of this invention further includes a guide plate 5 connected to the tubular portion 21 of the body 2 and disposed between the tubular portion 21 and the sound-absorbing sleeve 4. The guide plate 5 cooperates with the tubular portion 21 of the body 2 to define a gas-guiding space 51 therebetween. The gas-guiding space 51 has two openings 511 (see FIG. 16) disposed at a front end thereof.

Figure 6A:
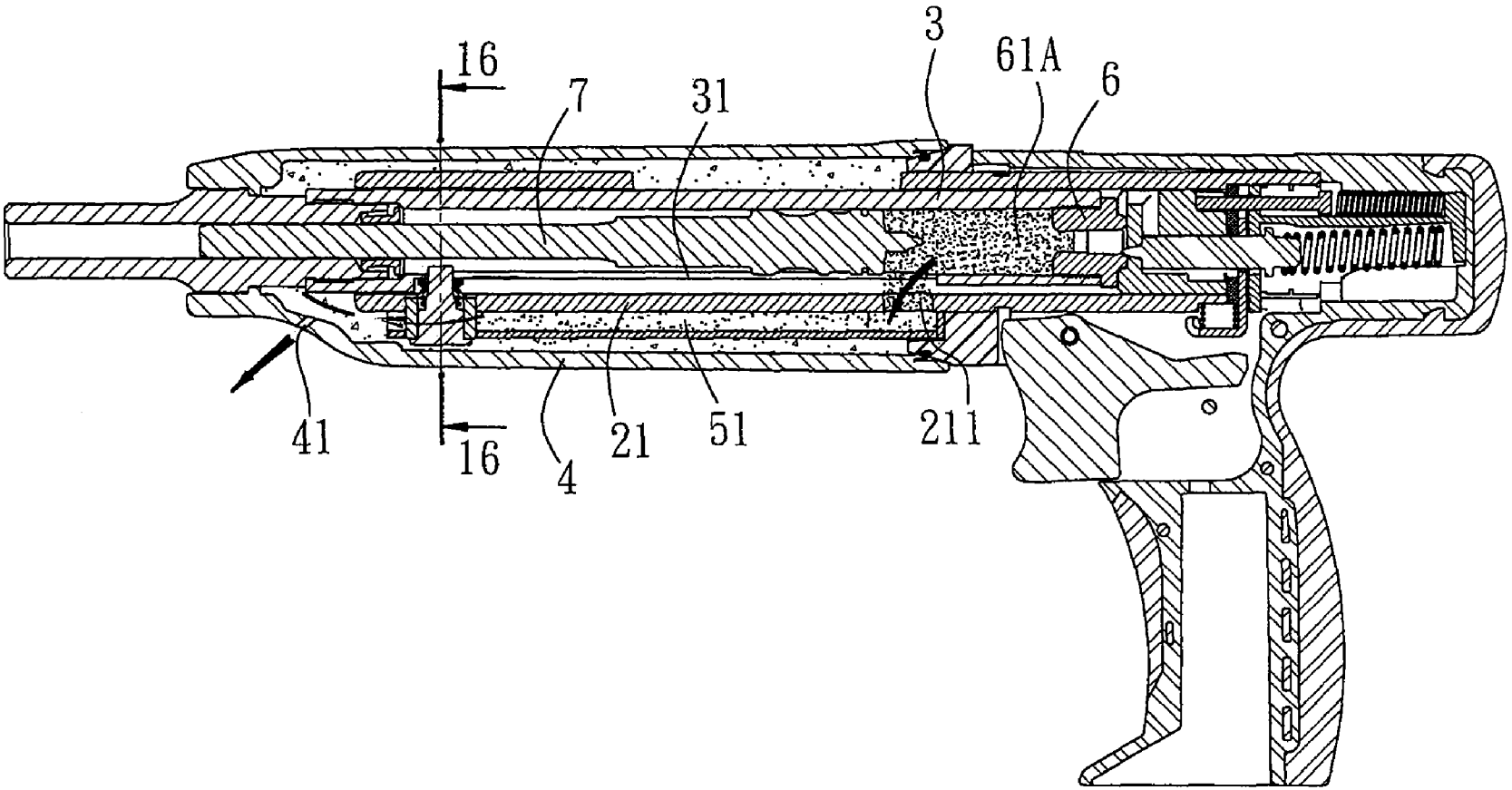
FIG. 6A is a schematic side view of the first preferred embodiment, illustrating how powder residue is discharged.
Figure 7:
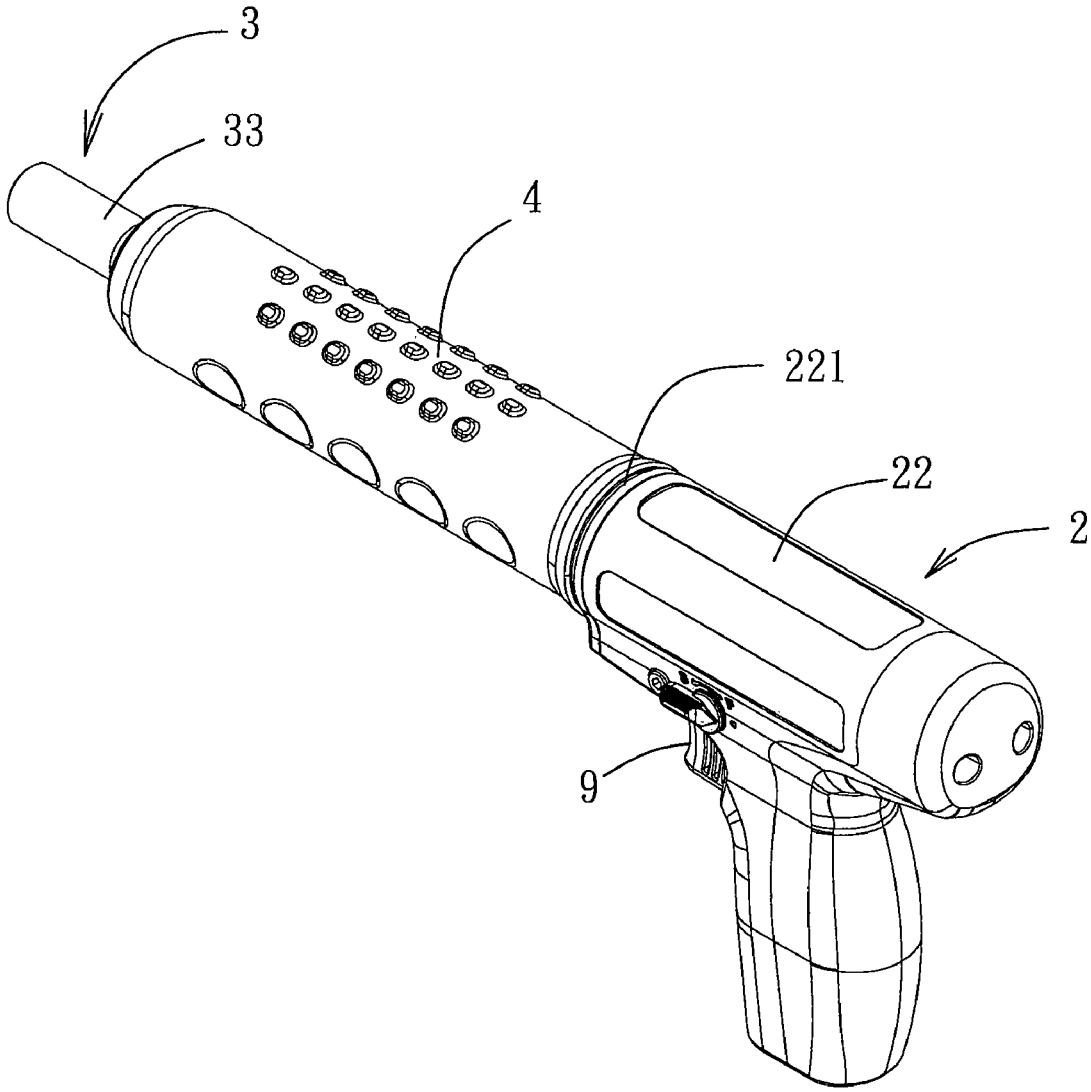
FIG. 7 is an assembled perspective view of the second preferred embodiment of a powder-actuated fastener-driving device according to this invention.
Figure 8:
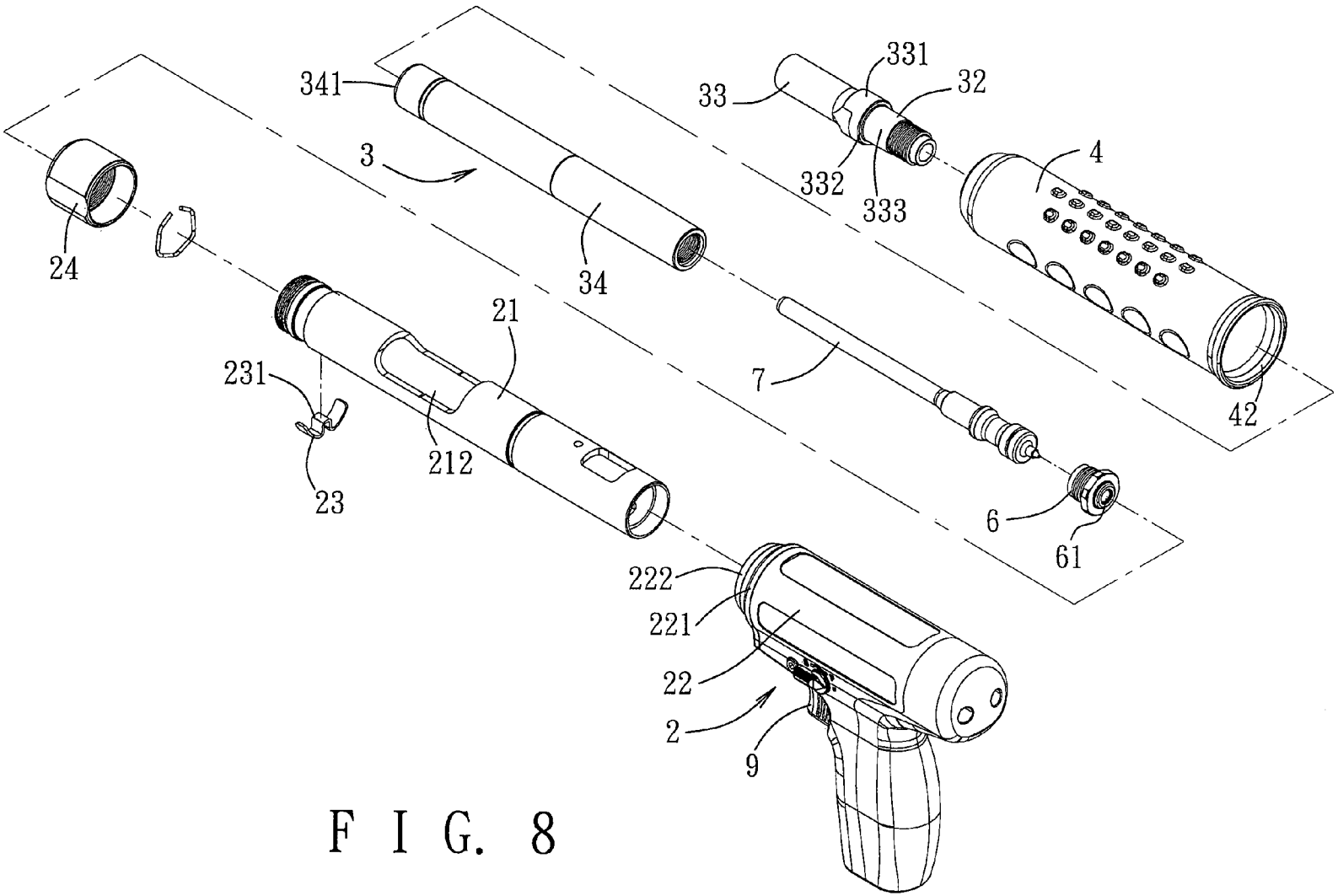
FIG. 8 is an exploded perspective view of the second preferred embodiment.
Figure 9:
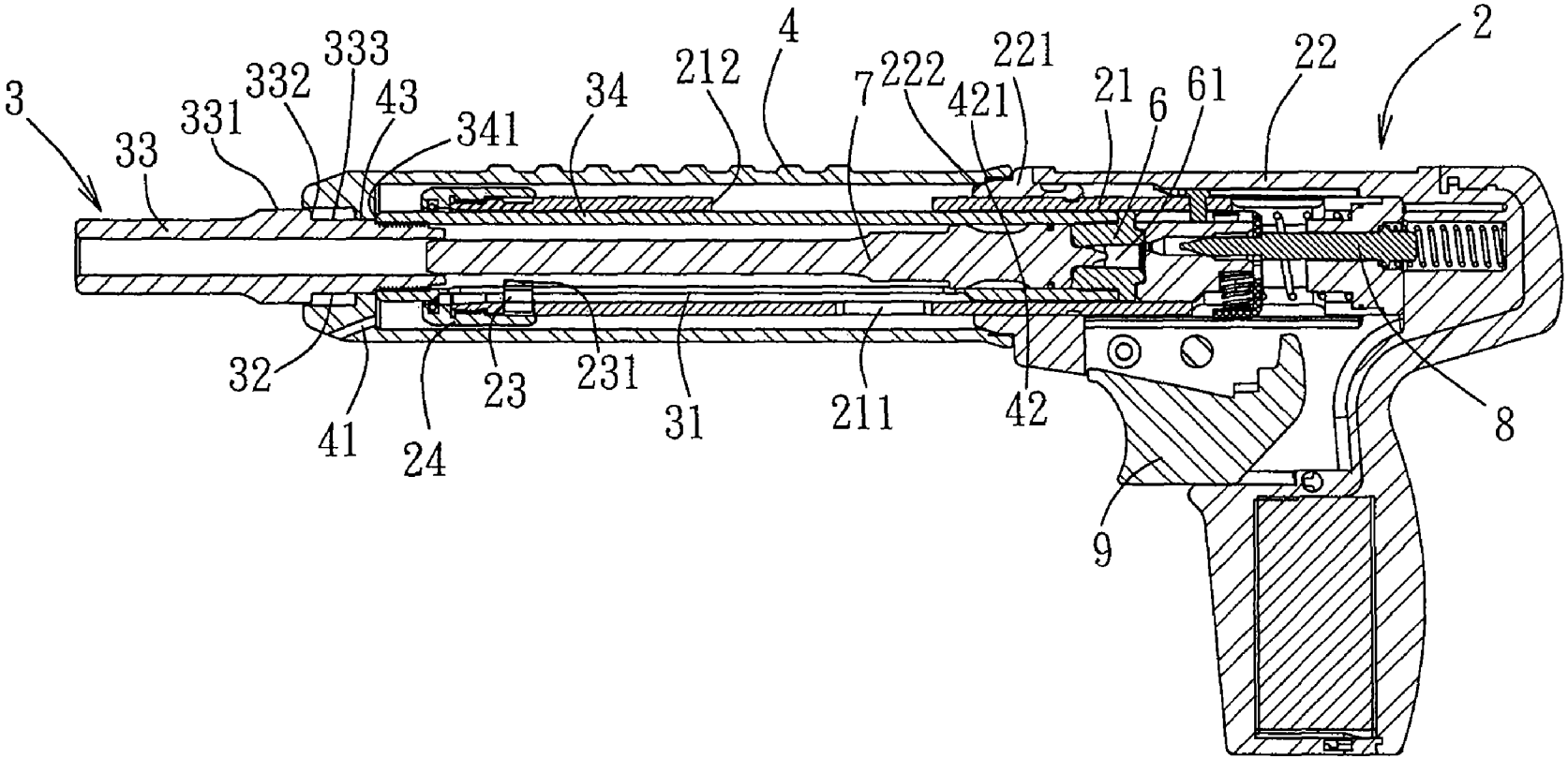
FIG. 9 is a sectional view of the second preferred embodiment, illustrating an inner tube in a normal position.
Figure 10:
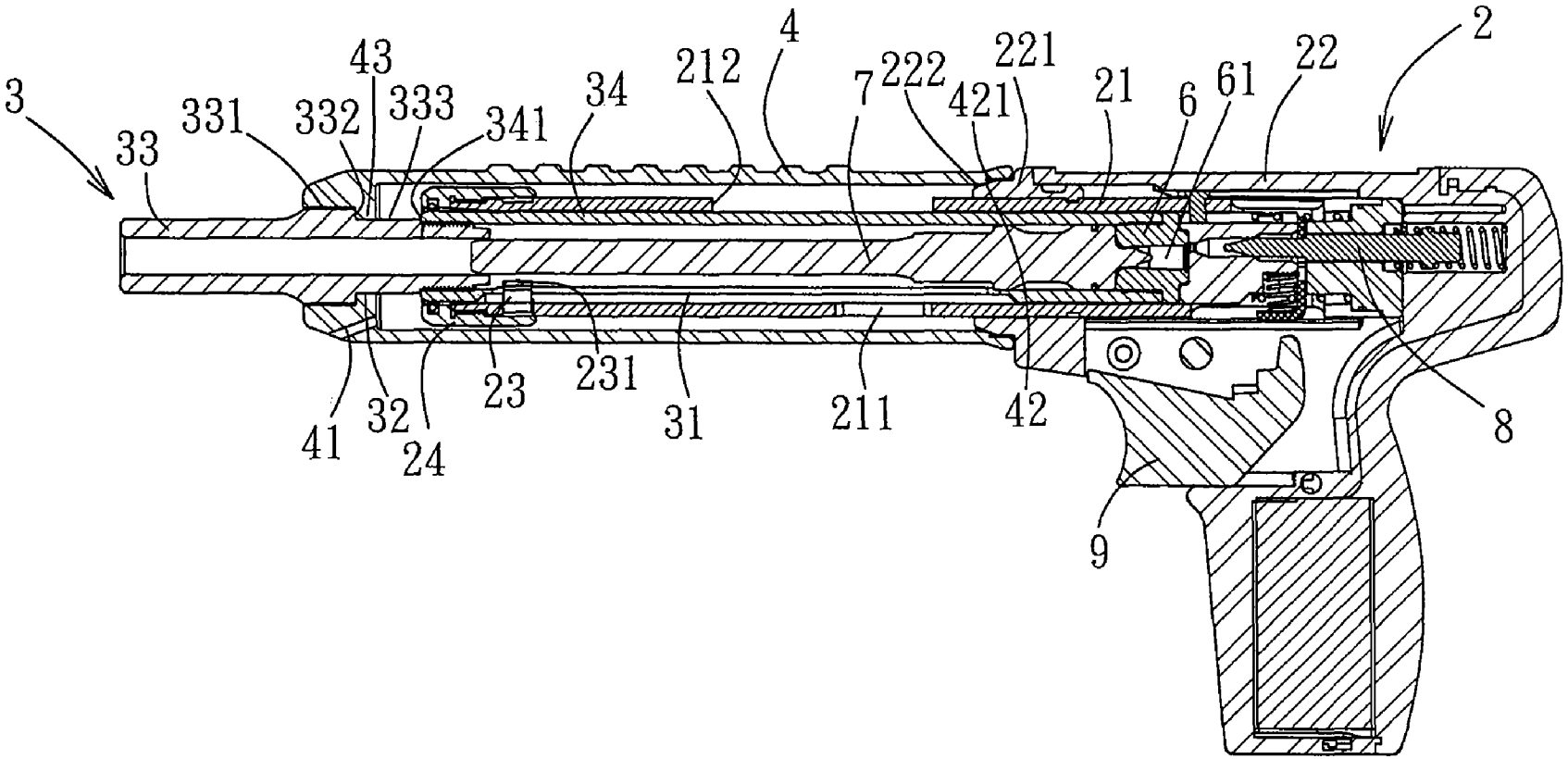
FIG. 10 is a view similar to FIG. 9 but illustrating the inner tube in a rear limit position.
Figure 11:
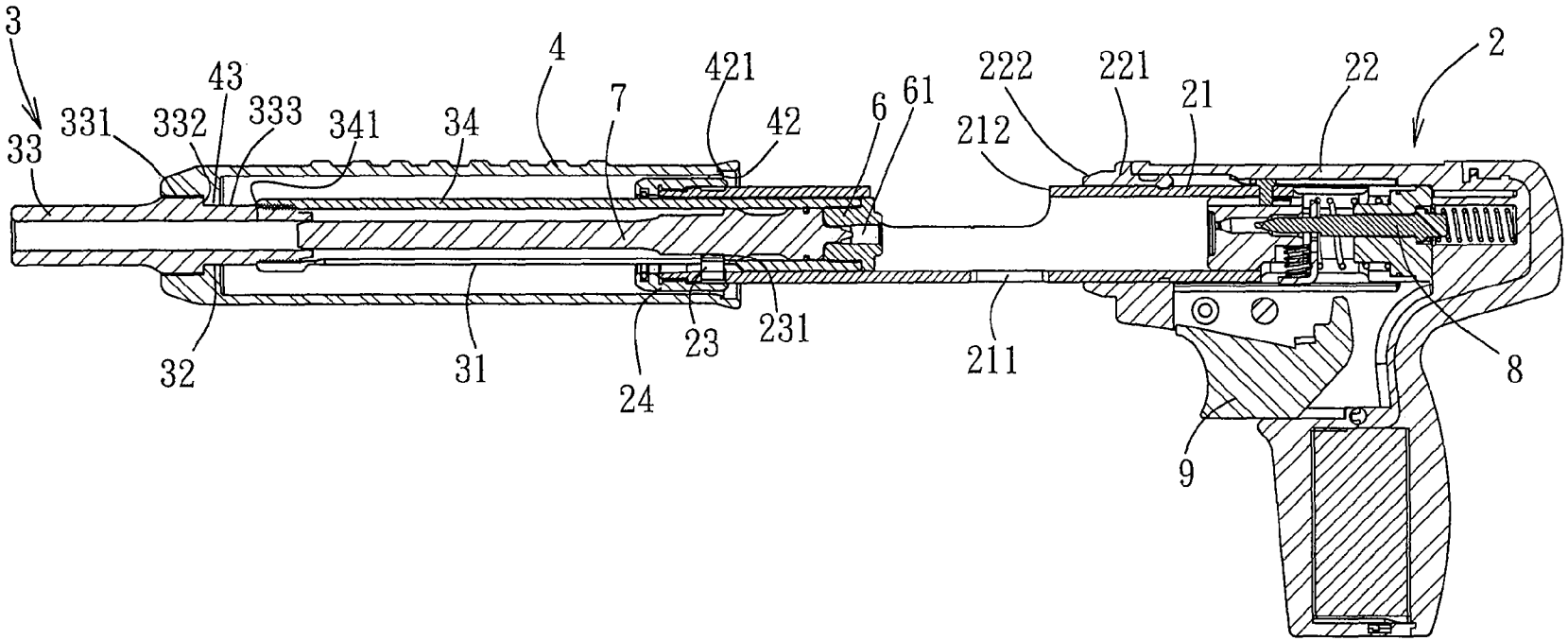
FIG. 11 is a view similar to FIG. 9 but illustrating the inner tube in a front limit position.

The sound-absorbing sleeve 4 is formed with two gas-discharging holes 41 in fluid communication with and adjacent to the openings 511 of the gas-guiding space 51. That is, the gas-discharging holes 41 are communicated fluidly with the surroundings. The number of the gas-discharge holes 41 may be one or more than two. With further reference to FIG. 6A, during outflow of the gas from the powder-actuated fastener-driving device through the gas-discharging holes 41, a first gas expansion occurs in the gas-generating space 61A, the slot 31 in the inner tube 3, and a space between the slot 31 and the tubular body 21 of the hollow body 2, a second gas expansion occurs in the gas-guiding space 51, and a third gas expansion occurs in a space defined between the tubular portion 21 and the sound-absorbing sleeve 4. That is, the design of such a flow path results in relatively slow expansion of the gas and generation of more small pressure impulses in distinction to the single high pressure impulse usually generated in the above-mentioned conventional powder-actuated fastener-driving devices, thereby reducing significantly the noise generated from the gas. During the explosion of the powder, when the piston 7 is pushed by the combustion gas to the position shown in FIG. 6A, a majority of powder residue carried within the gas is moved into the gas-guiding space 51 through the slot 31 and the gas-guiding hole 211 to thereby be discharged from the powder-actuated fastener-driving device through the openings 511 and the gas-discharging holes 41. As a result, the amount of the powder residue built-up within the inner tube 3 can be reduced significantly.

The front end of the inner tube 3 has an outer surface formed with a position-limiting groove 32. The sound-absorbing sleeve 4 has an inner surface formed with a position-limiting block 43. The position-limiting block 43 is movable forwardly and rearwardly within the position-limiting groove 32 to allow for forward and rearward movement of the inner tube 3 and the sound-absorbing sleeve 4 relative to each other.

In this embodiment, the inner tube 3 includes a first tube body 33 and a second tube body 34 connected to and disposed behind the first tube body 33. The first tube body 33 has a large-outer-diameter portion 331, a small-outer-diameter portion 333 connected to and disposed behind the large-outer-diameter portion 331, and a shoulder 332 defined between the large-outer-diameter and small-outer-diameter portions 331, 333. The second tube body 34 is sleeved on and threaded to the small-outer-diameter portion 333. The position-limiting groove 32 is defined among the shoulder 332, the small-outer-diameter portion 333, and a front end surface 341 of the second tube body 34.

Figure 5:
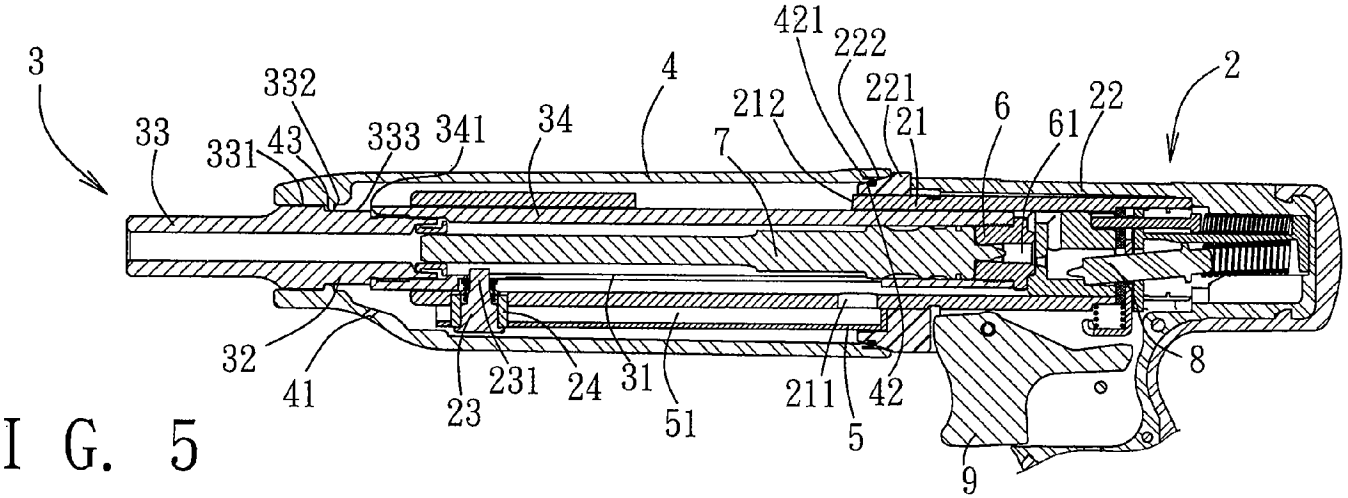
FIG. 5 is a view similar to FIG. 4 but illustrating the inner tube in a rear limit position.

An assembly of the position-limiting groove 32 and the position-limiting block 43 has two functions, the first one of which is to ensure safety during use of the powder-actuated fastener-driving device. The inner tube 3 is movable within the body 2 among a normal position shown in FIG. 4, a rear limit position shown in FIG. 5, and a front limit position shown in FIG. 6. When it is desired to perform a nail-driving operation, the front end of the inner tube 3 is pressed forwardly against a workpiece (not shown) so that the inner tube 3 and the cartridge-receiving sleeve 6 move rearwardly relative to the handle body 22. Hence, the inner tube 3 moves to the rear limit position, as shown in FIG. 5, to thereby convert the powder-actuated fastener-driving device into a stand-by state. Under this state, a nail can be fired from the powder-actuated fastener-driving device by operating the trigger 9, and the shoulder 332 of the first tube body 33 (i.e., the front end of the position-limiting groove 32) abuts against the position-limiting block 43 of the sound-absorbing sleeve 4, such that the sealing member 221 is clamped between the sound-absorbing sleeve 4 and the handle body 22. When the powder-actuated fastener-driving device is removed from the workpiece, the powder-actuated fastener-driving device is converted into a normal or idle state. The inner tube 3 is biased toward the normal position by a spring unit in a known manner such that the front end surface 341 of the second tube body 34 (i.e., the rear end of the position-limiting groove 32) abuts against the position-limiting block 43, as shown in FIG. 4. As such, when a rearward force is applied to the sound-absorbing sleeve 4, the rear end of the sound-absorbing sleeve 4 will abut against the sealing member 221 but the inner tube cannot be moved to the rear limit position. This ensures safety during use of the powder-actuated fastener-driving device.

The second function of the assembly of the position-limiting groove 32 and the position-limiting block 43 is to increase convenience during use of the powder-actuated fastener-driving device. In particular, when replacement of the powder cartridge in the accommodating chamber 61 in the cartridge-receiving sleeve 6 and return of the piston 7 to its original position are desired after one nail-driving operation, the sound-absorbing sleeve 4 is moved forwardly away from the handle body 22 from a position shown in FIG. 4 to the position shown in FIG. 6. During forward movement of the sound-absorbing sleeve 4, as soon as the position-limiting block 42 of the sound-absorbing sleeve 4 comes into contact with the shoulder 332 of the first tube body 33 of the inner tube 3 (i.e., the position-limiting block 43 moves to a front end of the position-limiting groove 32), the inner tube 3 is moved forwardly away from the handle body 22 by the position-limiting block 42 until it reaches the front limit position, thereby resulting in a two-stage operation. In the front limit position, the powder cartridge can be replaced. As such, during forward movement of the sound-absorbing sleeve 4, the inner tube 3 cannot move synchronously with the sound-absorbing sleeve 4 until the position-limiting block 42 moves to the front end of the position-limiting groove 32. In the first stage of the two-stage operation, since only the sound-absorbing sleeve 4 is moved, a small force is enough to move the same. In the second stage of the two-stage operation, due to inertia of the sound-absorbing sleeve 4, a force required for moving the sound-absorbing sleeve 4 and the inner tube 3 can be saved. Consequently, a force required for moving the sound-absorbing sleeve 4 to open the aperture 212 and returning the piston 7 to its original position can be reduced significantly.

When the replacement of the powder cartridge is finished, the sound-absorbing sleeve 4 is moved rearwardly toward the handle body 22. During rearward movement of the sound-absorbing sleeve 4, as soon as the position-limiting block 43 of the sound-absorbing sleeve 4 comes into contact with the front end surface 341 of the second tube body 34 (i.e., moves to a rear end of the position-limiting groove 32), the inner tube 3 is moved rearwardly toward the handle body 22 by the position-limiting block 43 until it reaches the normal position. Consequently, by operating simply the sound-absorbing sleeve 4, the piston 7 can be returned to its original position.

FIGS. 7 to 11 show the second preferred embodiment of a powder-actuated fastener-driving device according to this invention, which includes a hollow body 2, an inner tube 3, a cartridge-receiving sleeve 6, a piston 7, a firing device 8, and a sound-absorbing sleeve 4. This embodiment is similar in construction to the first preferred embodiment. The main differences between this embodiment and the first preferred embodiment reside in the following.

In this embodiment, the coupling member 24 is configured as a cylinder sleeved on the front end of the tubular portion 21, and the stop member 23 is configured as a W-shaped plate, and is clamped between an annular outer surface of the tubular portion 21 and an annular inner surface of the coupling member 24. The W-shaped plate has a projecting section 231 extending through the tubular portion 21 and disposed within the slot 31 in the inner tube 3.

In this embodiment, the guide plate 5 (see FIG. 3) is omitted to reduce the manufacturing cost. As such, since this embodiment has only two gas expansion spaces, the sound-absorbing effect of this embodiment is less than that of the first preferred embodiment. The second preferred embodiment has the same advantages as those of the first preferred embodiment, that is, the following advantages:

(1) Since more than one gas expansion space is formed in the powder-actuated fastener-driving device, the sound-absorbing effect is promoted.

(2) The flow path of the gas is arranged such that the amount of the powder residue discharged from the powder-actuated fastener-driving device can be increased, as described above. Thus, jamming of the piston 7 can be prevented, and the gas cannot be sprayed onto the user.

(3) The sealing member 221 cooperates with the annular inclined surface portions 42, 222 and the annular groove 421 to promote the sealing effect.

(4) The design of the position-limiting groove 32 and the position-limiting block 43 ensures safety during use, and results in convenience during operation.

Figure 12:
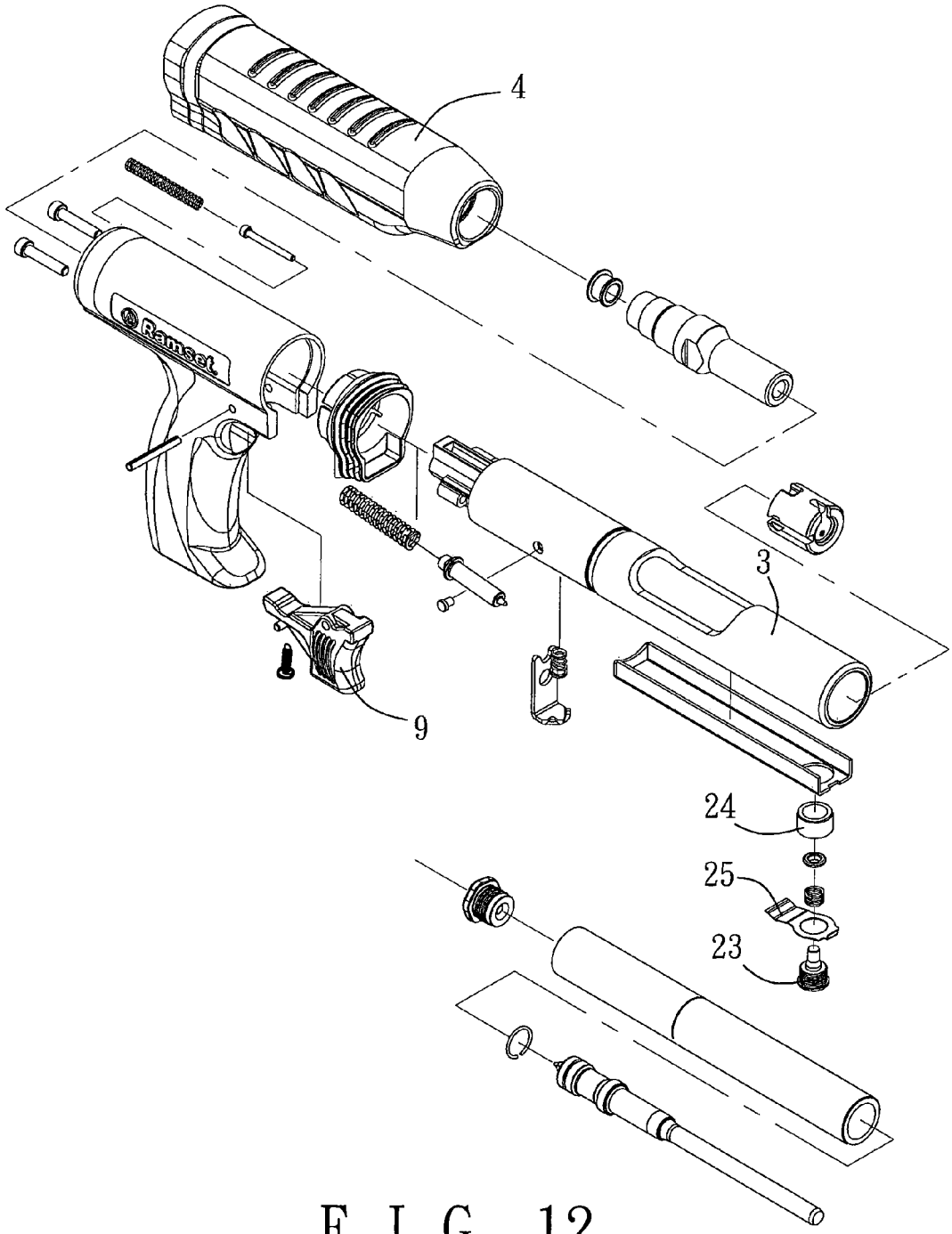
FIG. 12 is an exploded perspective view of the third preferred embodiment of a powder-actuated fastener-driving device according to this invention.
Figure 13:
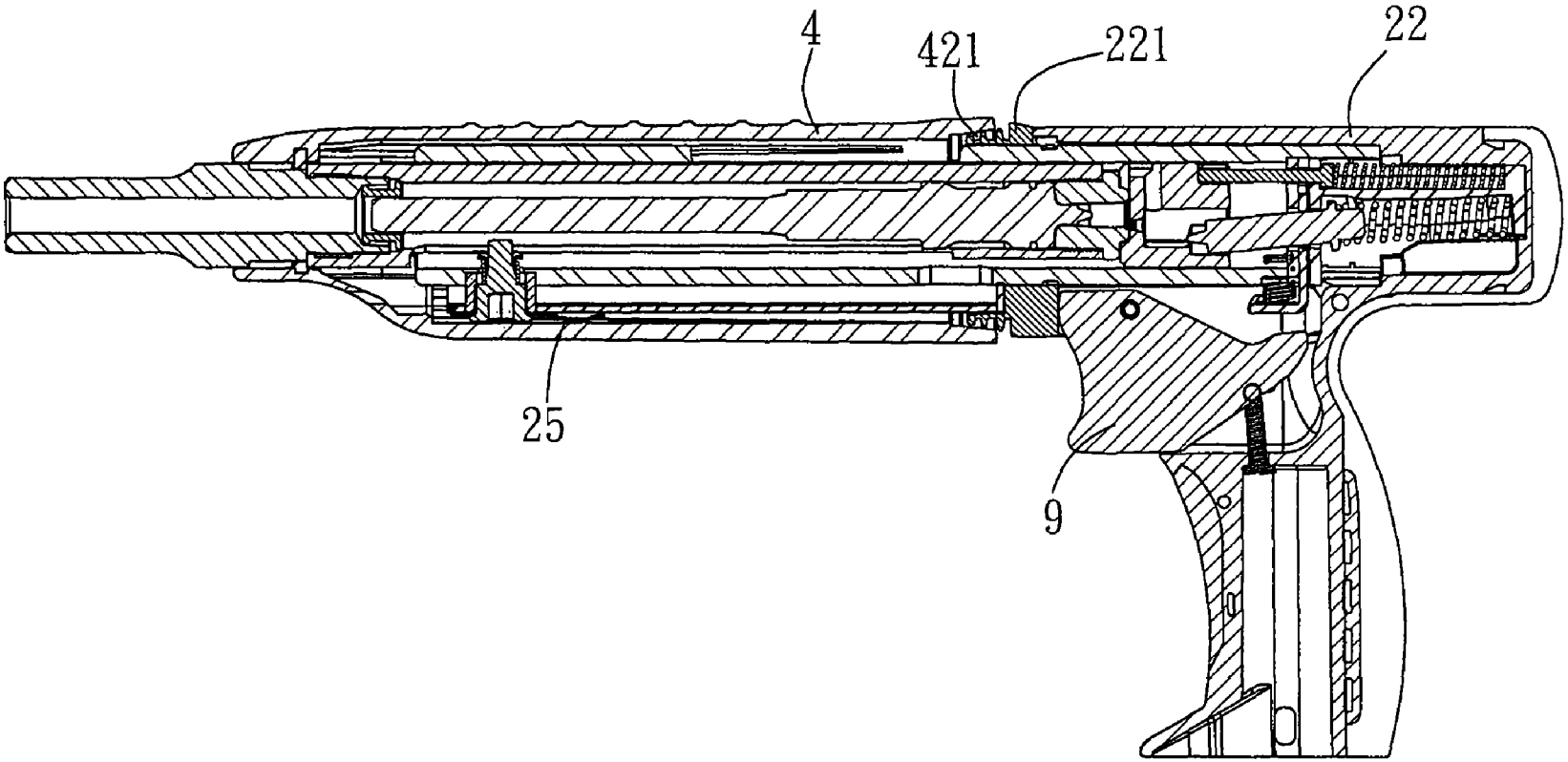
FIG. 13 is a sectional view of the third preferred embodiment.
Figure 14:
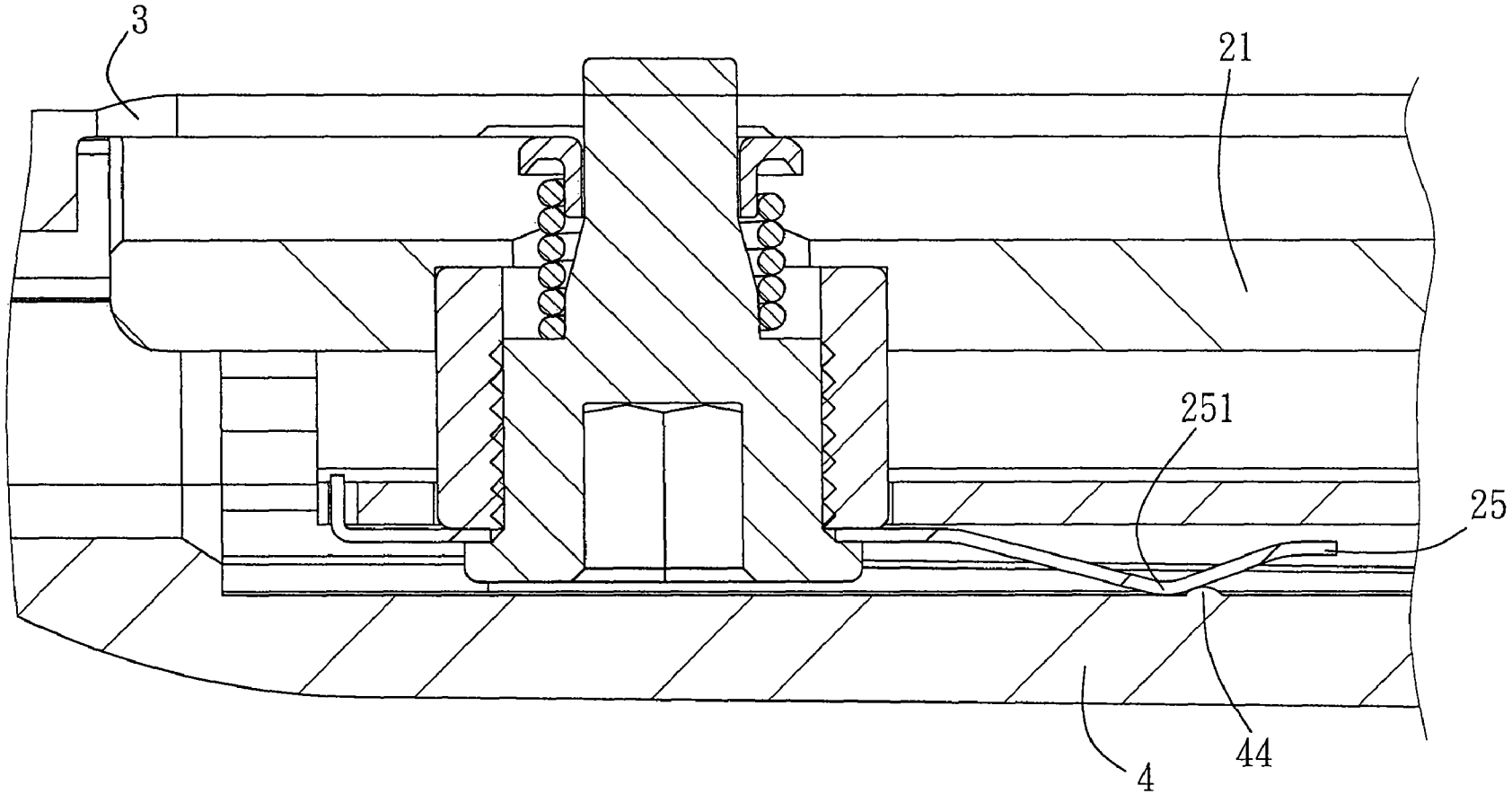
FIG. 14 is a fragmentary sectional view of the third preferred embodiment, illustrating a spring plate and a positioning projection.

FIGS. 12 to 14 show the third preferred embodiment of a powder-actuated fastener-driving device according to this invention, which is similar in construction to the first preferred embodiment. In this embodiment, the annular groove 421 is formed in the sealing member 221 instead of the sound-absorbing sleeve 4, and the powder-actuated fastener-driving device further includes a spring plate 25 attached to the stop member 23 and having an engagement portion 251. The sound-absorbing sleeve 4 has an engagement portion 44. In this embodiment, the engagement portions 251, 44 of the spring plate 25 and the sound-absorbing sleeve 4 are configured respectively as two projections. With particular reference to FIG. 14, when the sound-absorbing sleeve 4 is operated to move the inner tube 3 to the normal position so that the position-limiting block 43 of the sound-absorbing sleeve 4 is disposed at the rear end of the position-limiting groove 32 in the inner tube 3, the engagement portion 44 of the sound-absorbing sleeve 4 comes into contact with the engagement portion 251 of the spring plate 25, thereby preventing movement of the sound-absorbing sleeve 4 relative to the inner tube 3 that may occur by virtue of the gravity of the sound-absorbing sleeve 4 in a situation where the sound-absorbing sleeve 4 is inclined. Alternatively, the engagement portion 44 of the sound-absorbing sleeve 4 may be a cavity, hole, or groove for engaging the engagement portion 251 of the spring plate 25.

FIG. 15 shows the fourth preferred embodiment of a powder-actuated fastener-driving device according to this invention, which is similar in construction to the first preferred embodiment, except that the sealing member 221 is omitted. In this embodiment, the annular inclined surface portion 222 is disposed at the front end of the handle body 22.

With this invention thus explained, it is apparent that numerous modifications and variations can be made without departing from the scope and spirit of this invention. It is therefore intended that this invention be limited only as indicated by the appended claims.

I claim:

1. A powder-actuated fastener-driving device comprising:

a hollow body including a tubular portion having a rear end and an aperture formed through a wall thereof, and a handle including a handle body sleeved on said rear end of said tubular portion;

an inner tube movable forwardly and rearwardly within said tubular portion of said body and having a front end disposed outwardly of said tubular portion, and a slot formed through a wall of said inner tube and extending along a front-to-rear direction, said front end of said inner tube having an outer surface formed with a position-limiting groove;

a firing device disposed within said handle body of said body and adapted for igniting a powder cartridge;

a piston movable forwardly and rearwardly within said inner tube and adapted to be driven by the powder cartridge when said powder cartridge is ignited;

a stop member disposed on said tubular portion of said body and extending into said slot in said inner tube; and a sound-absorbing sleeve that is sleeved on a portion of said tubular portion disposed outwardly of said handle and that has an inner surface formed with a position-limiting block, said position-limiting block being movable forwardly and rearwardly within said position-limiting groove to allow for forward and rearward movement of said inner tube and said sound-absorbing block relative to each other such that, when said front end of said inner tube is pressed forwardly against an object, a rear end of said sound-absorbing sleeve comes into contact with a front end of said handle, synchronous forward movement of said inner tube and said sound-absorbing sleeve being allowed when said position-limiting block is disposed at a front end of said position-limiting groove and when said inner tube is movable forwardly relative to said hollow body, synchronous rearward movement of said inner tube and said sound-absorbing sleeve being allowed when said position-limiting block is disposed at a rear end of said position-limiting groove and when said inner tube is movable rearwardly relative to said hollow body, said sound-absorbing sleeve being movable away from said handle to expose said aperture outwardly of said sound-absorbing sleeve, thereby allowing for replacement of the powder cartridge;

wherein said tubular portion of said body is formed with a gas-guiding hole formed in a rear end portion thereof and aligned with said slot in said inner tube to allow gas produced within said inner tube during explosion of powder in the powder cartridge to be discharged from said powder-actuated fastener-driving device through said slot and said gas-guiding hole.

2. The powder-actuated fastener-driving device as claimed in claim 1, further comprising a guide plate connected to said tubular portion of said body and disposed between said tubular portion and said sound-absorbing sleeve to define a gas-guiding space between said guide plate and said tubular portion, said space having an opening disposed at a front end thereof.

3. The powder-actuated fastener-driving device as claimed in claim 2, wherein said sound-absorbing sleeve is formed with at least one gas-discharging hole adapted to be communicated fluidly with the surroundings.

4. The powder-actuated fastener-driving device as claimed in claim 3, wherein said gas-discharging hole is formed in a front end of said sound-absorbing sleeve.

5. The powder-actuated fastener-driving device as claimed in claim 1, wherein said sound-absorbing sleeve is formed with at least one gas-discharging hole adapted to be communicated fluidly with the surroundings.

6. The powder-actuated fastener-driving device as claimed in claim 1, wherein an outer surface of said handle has an annular inclined surface portion, and said inner surface of said sound-absorbing sleeve has an annular inclined surface portion movable into contact with said annular inclined surface portion of said inner surface of said sound-absorbing sleeve.

7. The powder-actuated fastener-driving device as claimed in claim 6, wherein said annular inclined surface portion of said inner surface of said sound-absorbing sleeve is formed with an annular groove.

8. The powder-actuated fastener-driving device as claimed in claim 1, wherein said body further includes a sealing member sleeved on the front end of the handle body, and the sealing member includes an O-ring made of an elastic material, the sound-absorbing sleeve being made of a rigid material such that, when said front end of said inner tube is pressed against the object, said sealing member is clamped between said sound-absorbing sleeve and said handle body.

9. The powder-actuated fastener-driving device as claimed in claim 8, wherein said inner surface of said sound-absorbing sleeve has an annular inclined surface portion, and an outer surface of said sealing member has an annular inclined surface portion in contact with said annular inclined surface portion of said inner surface of said sound-absorbing sleeve.

10. The powder-actuated fastener-driving device as claimed in claim 9, wherein said annular inclined surface portion of said inner surface of said sound-absorbing sleeve is formed with an annular groove.

11. The powder-actuated fastener-driving device as claimed in claim 9, wherein said annular inclined surface portion of said outer surface of said sealing member is formed with an annular groove.

12. The powder-actuated fastener-driving device as claimed in claim 1, wherein said inner tube includes a first tube body and a second tube body connected to and disposed behind said first tube body, said first tube body having a large-outer-diameter portion, a small-outer-diameter portion connected to and disposed behind said large-outer-diameter portion, and a shoulder defined between said large-outer-diameter portion and said small-outer-diameter portion, said position-limiting groove being defined among said shoulder, said small-outer-diameter portion, and a front end surface of said second tube portion.

13. The powder-actuated fastener-driving device as claimed in claim 1, wherein said inner tube is biased toward a normal position, said powder-actuated fastener-driving device further comprising a spring plate attached to said stop member and having an engagement portion, said sound-absorbing sleeve having an engagement portion that is positioned such that, when said inner tube is disposed at the normal position and when said position-limiting block is disposed at said rear end of said position-limiting groove, said engagement portion of said sound-absorbing sleeve engages said engagement portion of said spring plate to thereby prevent movement of said sound-absorbing sleeve relative to said inner tube.

14. The powder-actuated fastener-driving device as claimed in claim 13, wherein said engagement portions of said spring plate and said sound-absorbing sleeve are configured respectively as two projections movable into contact with each other.

* * * * *